United States Patent [19]

Yamada et al.

[11] Patent Number: 4,900,278

[45] Date of Patent: Feb. 13, 1990

[54] ELECTRIC CONNECTOR OF LOW-INSERTION FORCE

[75] Inventors: Shoji Yamada, Tokyo; Masami Sasao, Kawasaki; Yoshihisa Yamamoto, Yamato, all of Japan

[73] Assignee: Molex Incorporated, Lisle, Ill.

[21] Appl. No.: 389,444

[22] Filed: Aug. 4, 1989

[30] Foreign Application Priority Data

Aug. 4, 1988 [JP] Japan ..... 63-103657

[51] Int. Cl.[4] ..... H01R 13/00

[52] U.S. Cl. ..... 439/857; 439/924

[58] Field of Search ..... 439/857, 858, 861, 862, 439/891, 924

[56] References Cited

U.S. PATENT DOCUMENTS 4,734,041 3/1988 Bruchmann ..... 439/924

*Primary Examiner*—Joseph H. McGlynn

*Attorney, Agent, or Firm*—Louis A. Hecht; Stephen Z. Weiss

[57] ABSTRACT

Disclosed is an electrical connector of low-insertion force type comprising a male plug having at least one pin terminal, and a female socket having at least one contact. Each pin terminal has straight slant opposite surfaces extending downwards from the opposite ends of its flat nose at a same angle. The flat nose is positioned with its center somewhat beyond the center axis of the pin terminal, thereby placing the opposite slant surfaces asymmetrical with respect to the center axis of the pin terminal. Thus, the insertion force of the pin terminal reaches its peak value on one side of the pin terminal earlier than the insertion force of the pin terminal on the other side. This permits substantial reduction of the resultant insertion force. To an advantage, the straight inclination can be easily shaped with precision. This permits mass production of pin terminals of same insertion force characteristics.

3 Claims, 3 Drawing Sheets

ELECTRIC CONNECTOR OF LOW-INSERTION FORCE

BACKGROUND OF THE INVENTION

1. Field of the Invention

The present invention relates to an electric connector, and more particularly to an electric connector of plug-and-socket type which permits the insertion of the male plug into the female socket with a reduced insertion force.

2. Description of the Prior Art

As is well known, electric connectors of plug-and-socket type have been widely used. The male plug has pin terminals each having parallel opposite sides and converging slant surfaces whereas the female socket has contacts each having contact pieces and being adapted to accomodate the corresponding pin terminal, keeping the parallel opposite sides and converging slant surfaces of the pin terminal in resiliennt contact with the contact pieces of the contact.

Figure 5:
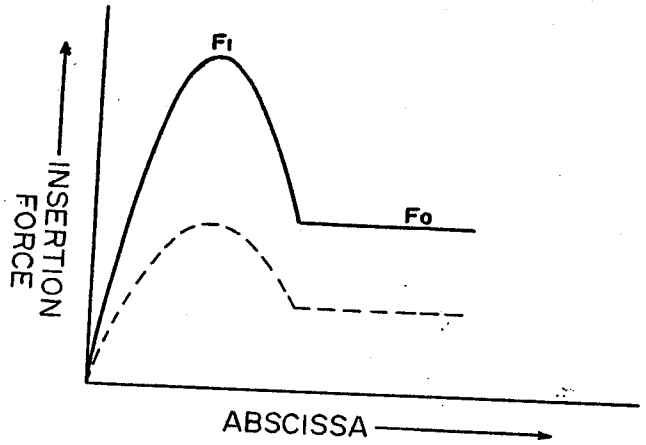
Figure 6:
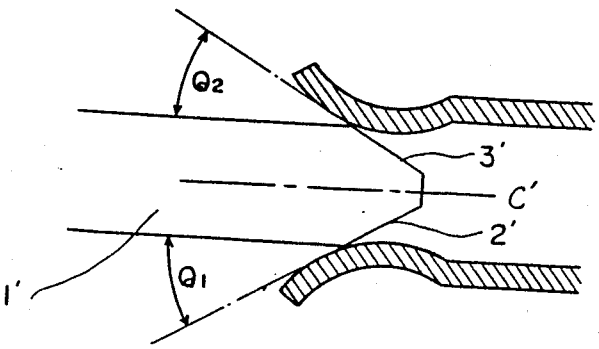

FIG. 6 shows such a conventional electric connector of plug-and-socket type. As shown, the tapering end of a pin terminal 1' has opposite slant surfaces 2' and 3' symmetrical with respect to the center axis C' of the pin terminal rod. Likewise, a pair of contact pieces are symmetrical with respect to the center axis C' of the contact. FIG. 5 shows how the insertions force (ordinate) varies with the insertion depth (abscissa).

As seen from this graph, as the pin terminal proceeds towards the final contact position with the tangential angle increasing, the insertion force increases until it has reached its peak value $F_1$. This value is generally called "insertion force". When the parallel opposite sides of the pin terminal reach the contact pieces, the tangential angle is trimmed exactly into desired curved surface by removing stretched portions from the punched piece or by reshaping somewhat deformed portions of the punched piece. This work is difficult, and therefore pin terminal each having more or less different curvatures on its opposite sides are likely to result. Thus, the insertion force cannot reach its peak value on each side at a controlled time. Stated otherwise, the precise shaping of curved surfaces on the opposite sides of the pin terminal requires the corresponding precision in punching dies used and in subsequent trimming work.

SUMMARY OF THE INVENTION

One object of the present invention is to provide an electric connector of low-insertion force type in which insertion force reaches it peak value earlier on one side of a pin terminal than on the other side, the tip end of the pin terminal having such a simple shape that the tip end can be easily formed into a desired shape which is exact enough to assure that the insertion force reaches its peak value on either side at controlled times.

Another object of the present invention is to provide an electric connector of low-insertion force type which permits of mass production of electric connectors of exactly same insertion force characteristics.

To attain these objects an electrical connector of low-insertion force comprising a male plug having at least one pin terminal and a female socket having at least one contact comprising a pair of symmetrical contact pieces, which are adapted to come into resilient contact with the opposite sides of the corresponding pin terminal, each of said pin reduced to zero, and then the insertion force levels off. This final constant value is indicated at $F_0$.

As seen from FIG. 6, the tapering end of the pin terminal 1' has opposite slant surfaces 2', 3' formed symmetrical at a same angle $\theta_1$, $\theta_2$ with respect to the center line C' of the pin terminal 1'. This arrangement causes the insertion force to rise simultaneously on either side of the pin terminal, and therefore, the resultant insertion force is twice as strong as the insertion force on either side, as indicated in solid lines in FIG. 5.

U.S. Pat. No. 4,769,890 proposes an electrical connector which is so designed that the insertion force to be applied between one side of a pin terminal and one of the contact pieces of an associated contact reaches its peak value at a time different from when the insertion force to be applied between the other side of the pin terminal and the other contact piece reaches its peak value. This electric connector comprises a male plug having terminal pins and a female socket having contacts. Each terminal pin has curved surfaces of different curvatures on its opposite sides, and each contact has a pair of contact pieces arranged symmetrical with respect to the center axis of the contact. This arrangement prevents the simultaneous rise of the insertion forces on the opposite sides of the pin terminal, and prevents the doubling of the resultant insertion force, attaining insertion of the pin terminal into the contact with a relatively low insertion force.

The U.S. Patent electric connector, however, has problems to be solved. A pin terminal is punched out from a piece of metal sheet with the aid of upper and lower punching dies, each having a curved blade. The punched piece of metal is terminals being so designed that the insertion force to be applied between on side of the corresponding pin terminal and one of the contact pieces reaches its peak value at a time different from when the insertion force to be applied between the other side of the corresponding pin terminal and the other contact piece reaches its peak value, is improved according to the present invention in that: each of said pin terminals has a tapered end ending with a flat nose, said tapered end comprising a first slant surface extending from one end of said flat nose to said one side of pin terminal and a second slant surface extending from the other end of said flat nose to said the other side of pin terminal, said first and second slant surfaces being inclined at a same angle with respect to the center axis of said pin terminal, and the center or equi-divisional point of said flat nose being positioned somewhat beyond the center axis of said pin terminal, thereby positioning said first and second slant surfaces asymmetrical with respect to the center axis of said pin terminal so as to put at differnt places, the intersections at which said first and second slant surfaces intersect with said one and the other sides of pin terminal, thus causing the insertion forces on said first and second slant surfaces to reach their peak values at different times.

According to one embodiment of the present invention said male plag has a single pin terminal. According to another embodiment of the present invention said male plag has a plurality of pin terminals.

When the pin terminal of the male plug is inserted between the opposite contact pieces of the female socket, the insertion force reaches its peak value on one side of the pin terminal earlier than on the other side, preventing simultaneous rise of the insertion forces on the opposite sides of the pin terminal to their peak values, hence permitting insertion of the pin terminal into the contact with a reduced insertion force.

To an advantage, the tip end of the pin terminal can be easily formed into a precise shape as required partly because the slant and consecutive side of the pin terminal is straight rather than curved and partly because the slant surfaces are inclined at the same angle. This also, is advantageous to the shaping of punching dies into precise shape and precise dimensions. To give a pin terminal a precise shape as required, it suffices that the intersections at which the slant surfaces intersect with the parallel sides of the pin terminal, are precisely positioned.

Figure 1:
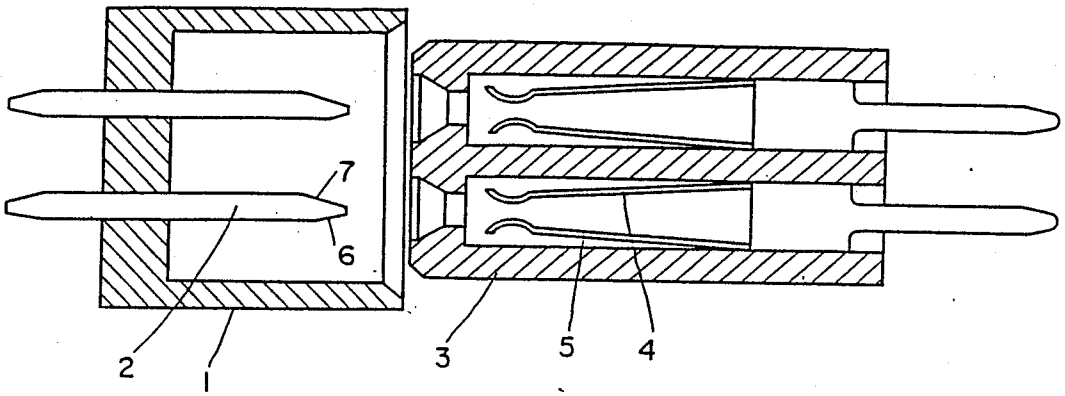
Figure 3:
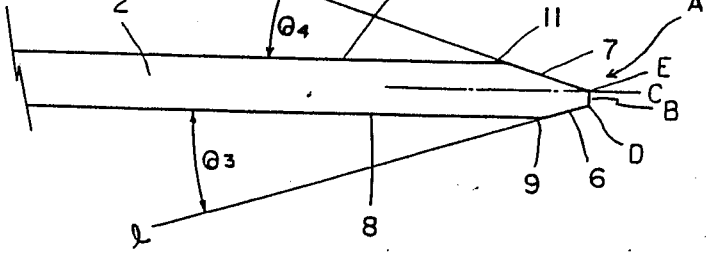
Figure 2:
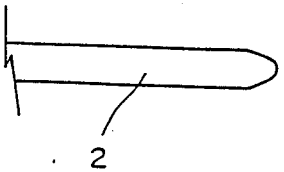
Figure 4:
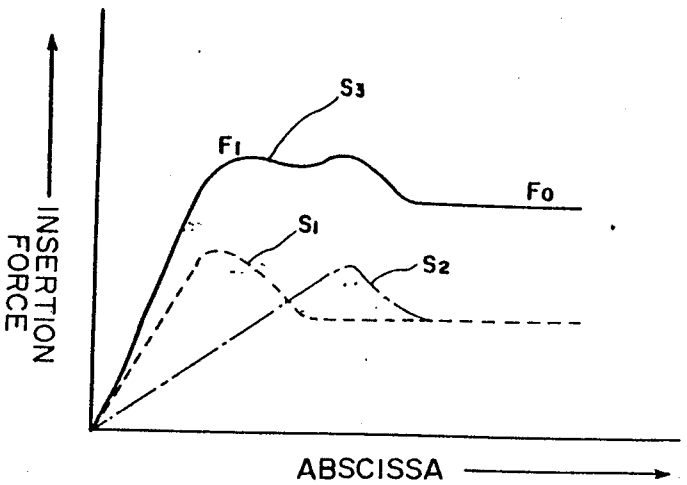

Other objects and advantags of the present invention will be understood from the following description of an electric connector according to one embodiment of the present invention, which is shown in attached drawings:

FIG. 1–4 show an electric connector according to one embodiment of the present invention: specifically, FIG. 1 is a logitudinal section of the male plug and female socket of the electrical connector; FIG. 2 is a side view of a pin terminal as viewed from a position 90 degrees apart from that which is viewed in FIG. 1; FIG. 3 is an enlarged side view of the pin terminal, showing the asymmetrical arrangement of opposite slant surfaces with respect to the center axis; FIG. 4 is a graph showing how the insertion force varies with the insertion depth in the electric connector of the present invention; FIG. 5 is a graph showing how the insertion force varies with the insertion depth in a conventional electric connector; and FIG. 6 is an enlarged longitudinal section of the contact pieces of the connector, showing the symmetrical arrangement of the contact pieces with respect to the center axis of the contact.

Referring to FIG. 1 to 4, a male plug 1 has pin terminals 2, and a female socket 3 has contacts 5 each comprising a pair of opposite resilient contact pieces 4 and 5. In this particular embodiment two pin terminals are used. A single pin terminal or a plurality of terminals can be used. In these drawings less improtant parts are omitted only for the sake of the simplicity of the drawings.

FIG. 2 is a side view of a pin terminal as viewed from a position 90 degrees apart from that which is viewed in FIG. 1.

To attain the object as described above, each pin terminal 2 has a tapered end A ending with a flat nose B. The tapered end A comprises a first slant surface 6 extending from one end D of the flat nose B to one side 8 of the pin terminal 2 and a second slant surface 7 extending from the other end E of the flat nose B to the other side 10 of the pin terminal 2. The first and second slant surfaces 6, 7 are inclined at a same angle $\theta_3$, $\theta_4$ with respect to the center axis C of the pin terminal 2, and the center or equidivisional point of the flat nose B is positioned somewhat beyond the center axis C of the pin terminal 2, thereby positioning the first and second slant surfaces asymmetrical with the center axis C of the pin terminal 2 so as to put at different places, the intersections 9 and 11 at which the first and second slant surfaces 6 and 7 intersect with one and the other sides 8 and 10 of the pin terminal 2 respectively, thus causing the insertion forces on the first and second slant surfaces to reach their peak values at different controlled times.

FIG. 3 shows an enlarged side view of the tapering end of the pin terminal 2.

When the pin terminal 2 is inserted into a pair of contact pieces 4 and 5 of the contact, first, the insertion force reaches its peak value on the side on which the slant surface 6 of the pin terminal 2 comes to contact with the contact piece 5 of the contact, as seen from the curve $S_1$ (broken lines) in FIG. 4.

In a certain length of time the insertion force reaches its peak value on the side on which the slant surface 7 of the pin terminal 2 comes to contact with the contact piece 4 of the contact, as seen from the curve $S_2$ (broken lines) in FIG. 4. The resultant insertion force $S_3$ is indicated by the curve $S_3$ solid lines. As seen from this curve, the peak value $F_1$ of the resultant insertion force curve $S_3$ is far less than double of the peak value of the insertion force on each side of the pin terminal 2. Thus, the pin terminal 2 can be inserted into the contact with a reduced insertion force.

What is claimed is:

1. An electrical connector of low insertion force comprising a male plug 1 having at least one pin terminal 2 and a female socket 3 having at least one contact comprising a pair of symmetrical contact pieces 4 and 5, which are adapted to come into resilient contact with the opposite sides 8, 10 of the corresponding pin terminal 2, each of said pin terminals being so designed that the insertion force to be applied between one side 8 of the corresponding pin terminal 2 and one of the contact pieces 5 reaches its peak value at a time different from when the insertion force to be applied between the other side 10 of the corresponding pin terminal 2 and the other contact piece 4 reaches its peak value, characterized in that: each of said pin terminals has a tapered end A ending with a flat nose B, said tapered end A comprising a first slant surface 6 extending from one end D of said flat nose B to said one side 8 of pin terminal 2 and a second slant surface 7 extending from the other end E of said flat nose B to said the other side 10 of pin terminal 2, said first and second slant surfaces 6, 7 being inclined at a same angle with respect to the center axis C of said pin terminal 2, and the center or equi-divisional point of said flat nose B being positioned somewhat beyond the center axis C of said pin terminal 2, thereby positioning said first and second slant surfaces asymmetrical with respect to the center axis C of said pin terminal 2 so as to put at different places, the intersections at which said first and second slant surfaces 6 and 7 intersect with said one and the other sides 8 and 10 of pin terminal 2, thus causing the insertion forces on said first and second slant surfaces reach their peak values at different times.

2. An electrical connector of low insertion force according to claim 1 wherein said male plug 1 has a single pin terminal 2.

3. An electrical connector of low insertion force according to claim 1 wherein said male plug 1 has a plurality of pin terminals 2.

* * * * *